United States Patent [19]

Barkus et al.

[11] Patent Number: 4,952,172

[45] Date of Patent: Aug. 28, 1990

[54] ELECTRICAL CONNECTOR STIFFENER DEVICE

[75] Inventors: Lee A. Barkus, Millersburg; David B. Sinisi, Harrisburg, both of Pa.

[73] Assignee: AMP Incorporated, Harrisburg, Pa.

[21] Appl. No.: 380,067

[22] Filed: Jul. 14, 1989

[51] Int. Cl.[5] ..... H01R 13/639

[52] U.S. Cl. ..... 439/532; 439/79

[58] Field of Search ..... 439/59, 62, 64, 65, 439/76, 79, 92, 95, 532, 607, 609, 713, 715, 716

[56] References Cited

U.S. PATENT DOCUMENTS 3,260,986 7/1966 Staffel ..... 439/716

3,277,427 10/1966 Jurca ..... 439/716

4,655,518 4/1987 Johnson et al. ..... 339/

*Primary Examiner*—Eugene F. Desmond

*Assistant Examiner*—Walter G. Hanchuk

*Attorney, Agent, or Firm*—Allan B. Osborne

[57] ABSTRACT

A stiffener device for use with electrical connectors. More particularly, the stiffener device includes a rigid L-shaped member having a groove in which an electrical connector is slidingly received and locking clips which are attached to the connector and frictionally received in a channel in the L-shaped member to prevent relative movement between the member and connector.

7 Claims, 3 Drawing Sheets

ELECTRICAL CONNECTOR STIFFENER DEVICE

FIELD OF THE INVENTION

The present invention relates to devices which are attached to electrical connectors to keep them from bowing along the longitudinal axis.

BACKGROUND OF THE INVENTION

It is known from U.S. Pat. No. 4,655,518 to provide an aluminum stiffener device to both cover otherwise exposed contact elements in the connector and also to provide structural to the plastic connector housing. The stiffener device disclosed is connected to the connector housing by screws and is also similarly connected to the daughter card.

Whereas the device discussed above is very adequate, it is not well adapted for use with a plurality of short length receptacles referred to as "modules". Accordingly, it is now proposed to provide a stiffener device which is well suited for use with modules as well as with elongated connectors.

SUMMARY OF THE INVENTION

According to the invention, a stiffener device is provided which includes a rigid member for slidingly receiving an electrical connector and one or more locking clips which attach to the connector and are frictionally received in a channel in the rigid member to prevent relative movement between the rigid member and connector.

DESCRIPTION OF THE INVENTION

Figure 1:
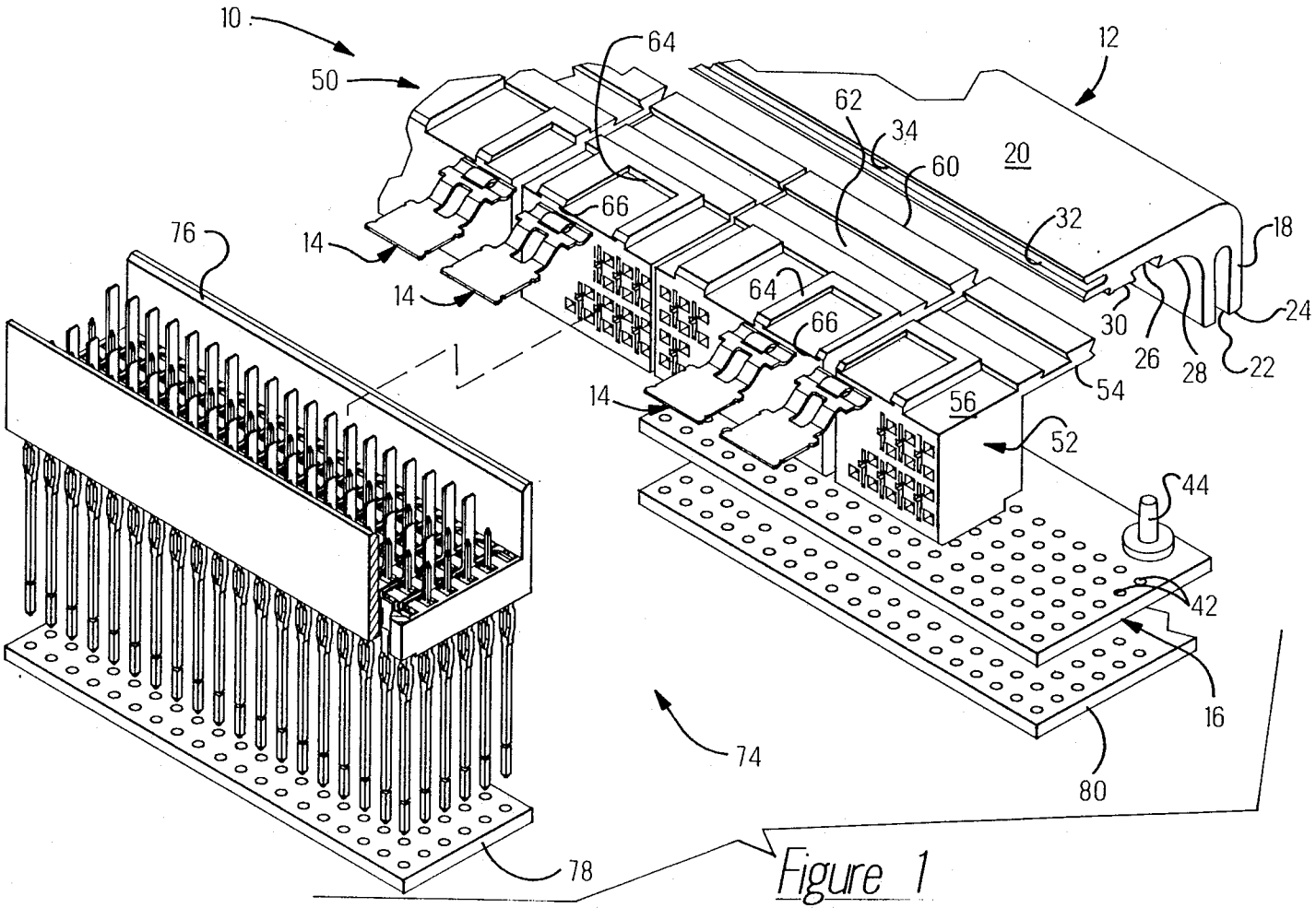
FIG. 1 is an exploded, perspective view of a stiffener device of the present invention and the electrical connector system with which it is used.

Stiffener device 10, as shown in FIG. 1 includes member 12, locking clips 14 and spacer 16. Member 12 is an L-shaped aluminum extrusion with legs 18,20 at right angles to each other. Leg 18 includes channel 22 extending thereinto from free edge 24 and extending along the length thereof. Leg 20 is provided with a keystone shaped groove 26 in the inside surface 28, and adjacent and parallel thereto a keystone shaped rib 30. Channel 32 extends into leg 20 from free edge 34 and extends along the length thereof also.

Figure 3:
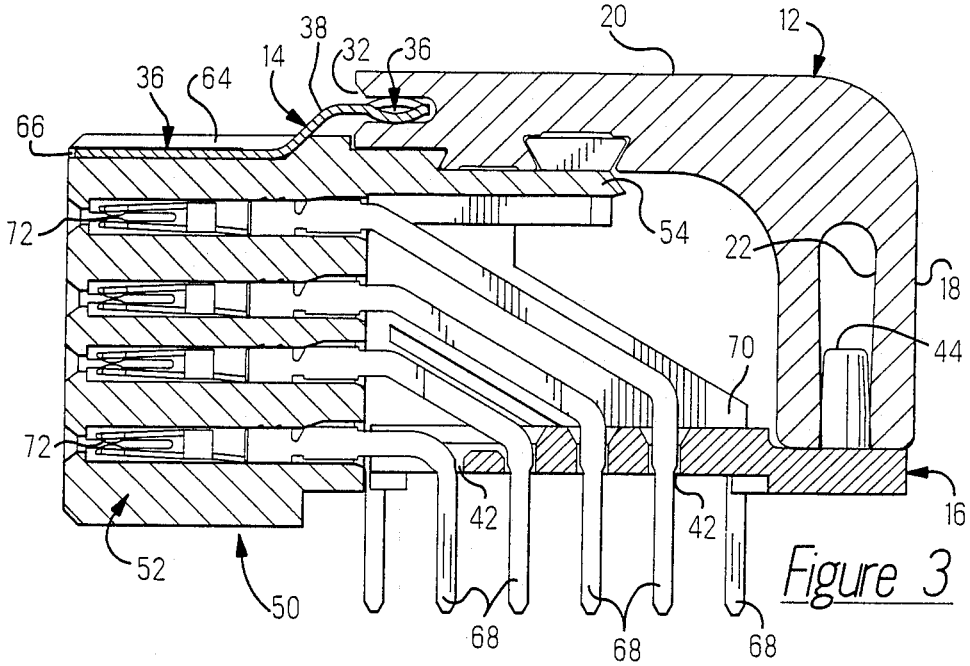
FIG. 3 is a cross-sectional view taken along line 3—3 in FIG. 2.
Figure 4A:
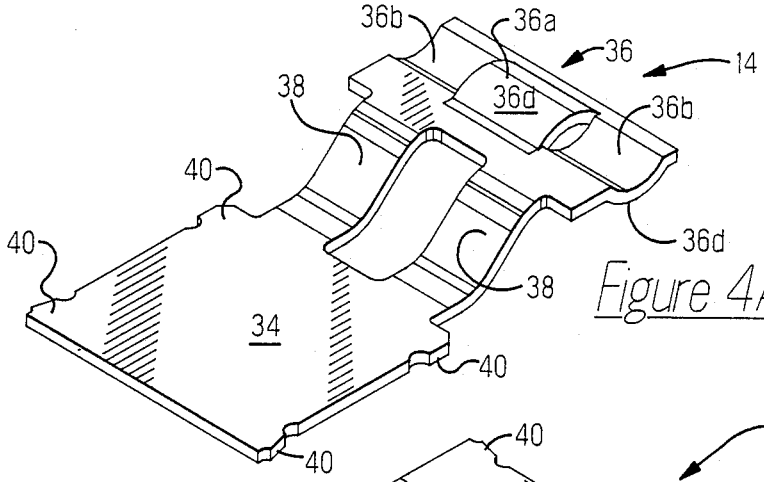
FIGS. 4A and 4B are perspective views of the locking clip of the present invention.
Figure 4B:
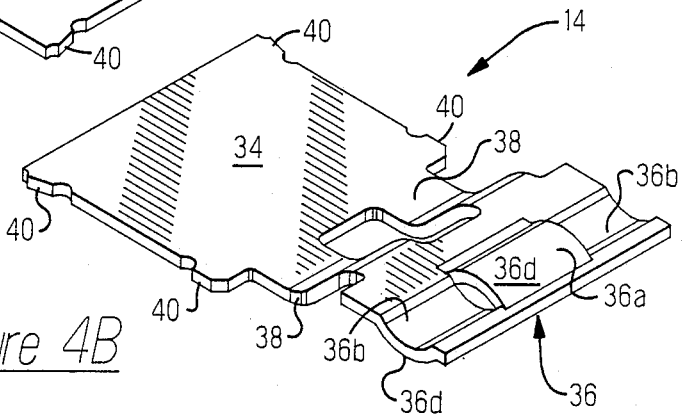

Locking clips 14, seen in FIGS. 4A and 4B more clearly, include plate section 34 at one end and spring section 36 at the opposite end with straps 38 attached to and extending therebetween. As shown in FIGS. 3, 4A and 4B, straps 38 are bent to offset sections 34,36 relative to each other. Plate section 34 includes outwardly projecting ears 40 on respective sides. Spring section 36 is formed into center spring portion 36*a* and outer spring portions 36*b*, one on each side of center spring portion 36*a*. As shown portions 36*a*, and 36*b* are arcuate-shaped with convex surfaces 36*d* facing outwardly.

Locking clips 14 are preferably made from stainless steel.

Spacer 16 is made from a dielectrical material and is provided with holes 42 in a pre-determined pattern and mounting studs 44 adjacent one longitudinal edge.

As shown in FIG. 1, connector 50 to which stiffener device 10 is attached includes housing 52 with side wall 54 extending outwardly from side surface 56. A keystone-shaped rib 58 extends longitudinally adjacent to an along free edge 60 and a keystone-shaped groove 62 extends parallel and adjacent to rib 58. Three-sided frames 64 on side surface 56 include inwardly facing grooves 66. As shown, frames 64 and grooves 66 open out in a direction away from side wall 54.

Figure 2:
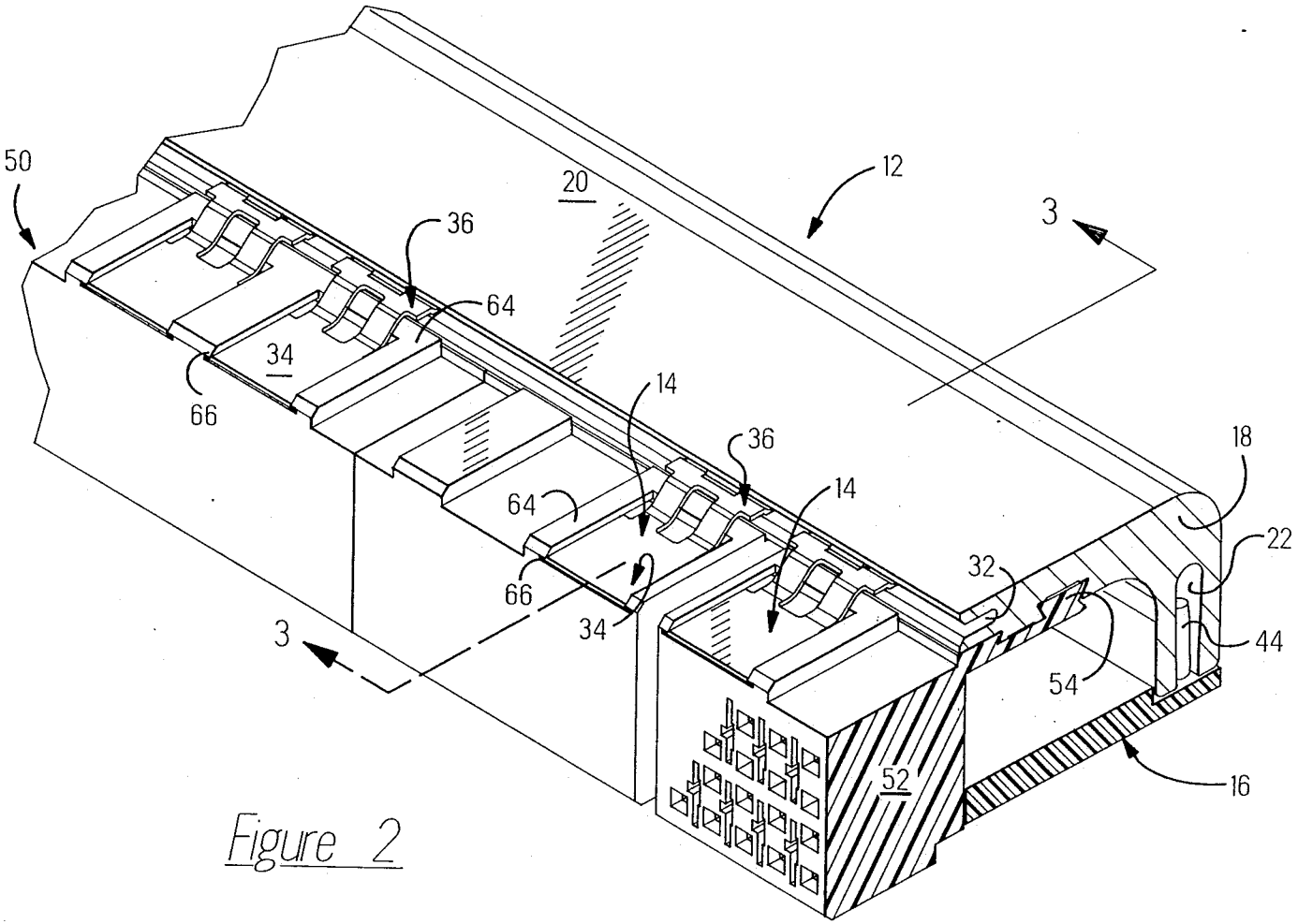
FIG. 2 is a perspective view of the stiffener device assembled to the receptacle modules of the electrical connector system.

With reference to FIGS. 2 and 3, one or more connectors 50 are slid onto member 12 from an end with grooves 26,62 receiving ribs 58,30 respectively. After being positioned as desired, locking clips 14 are attached with ears 40 on plate section 34 being frictionally received in grooves 66 in frames 64 and spring section 36 being frictionally received in channel 32. Clips 14 prevent relative sliding movement of connectors 50 and member 12. Spacer 16 is attached to member 12 with studs 44 being frictionally received in channel 22. Leads 68 on contact elements 70,72 in housing 52 of connector 50 extend thru holes 42.

Stiffener device 10 is advantageously used with electrical connector systems 74 shown in FIG. 1. System 74 includes connectors 50, known as receptacles, and mating connector 76, known as a headers. Connector 76, which is mounted on back panel 78, receives a number of connectors 50 to which daughter card 80 is attached. Stiffener device 10 provides structural support to connectors 50 as well as a means for positioning them in a desired pattern.

As can be discerned, a stiffener device has been disclosed for use with electrical connector systems. The stiffener device includes an elongated L-shaped member which receives receptacle connectors of the electrical connector system. The device further includes locking clips which removably lock the connectors to the L-shaped member. Also disclosed is a spacer for use with the member.

We claim:

1. An improvement to an elongated, rigid stiffener device for being attached to and used to prevent bowing of electrical connectors of the type having conductive leads extending outwardly therefrom for electrical engagement with printed circuit cards, said improvement comprising:

an outwardly open channel extending along one free edge of the stiffener device;

means to removably attach said stiffener device to both at least one electrical connector and a printed circuit card electrically engaged to said at least one electrical connector; and locking clips having plate means at one end for being attached to a connector and a spring section at another end for being frictionally received in said channel to prevent relative movement between the connector and the stiffener device.

2. The improvement of claim 1 wherein said spring section is offset from said plate means.

3. The improvement of claim 2 wherein said spring section includes a pair of arcuate-shaped spring portions having convex surfaces and with respective said convex surfaces facing outwardly in opposite directions relative to each other.

4. A stiffener device used to prevent bowing of electrical connectors of the type having conductive leads extending outwardly from a dielectric housing for electrical engagement with printed circuit cards, said stiffener device comprising:

an elongated, rigid, L-shaped member having an outwardly open channel along a free edge of and means for receiving one or more connectors on one leg and means for receiving spacer means on another leg; and locking clips having means for being attached to the connector at one end and a spring section at another end for being frictionally received in said channel to prevent relative movement between the connector and rigid member.

5. The device of claim 4 wherein said spring section includes a plurality of arcuate-shaped spring portions having outwardly facing convex surfaces for frictionally engaging said channel and with at least two of said convex surfaces facing outwardly in opposite directions relative to each other.

6. The device of claim 5 wherein said means for being attached to the connection include a plate.

7. The device of claim 6 wherein said spring section is offset from the plane of said plate.

* * * * *